US006141428A

United States Patent [19]

Narus

[11] Patent Number: 6,141,428

[45] Date of Patent: Oct. 31, 2000

[54] AUDIO SPEAKER SYSTEM

[76] Inventor: Chris Narus, 39 Cambridge Dr., Southington, Conn. 06489

[21] Appl. No.: 08/162,364

[22] Filed: Oct. 28, 1993

[51] Int. Cl.[7] ..... H04R 25/00

[52] U.S. Cl. ..... 381/338; 381/345; 381/349; 181/156; 181/199

[58] Field of Search ..... 381/154, 86, 90, 381/188, 205, 24, 338, 345, 349, 351, 87, 89, 332, FOR 141, 300, 335; 181/156, 141, 153, 199, 144, 145

[56] References Cited

U.S. PATENT DOCUMENTS

| | | | |
|---|---|---|---|
| 4,638,884 | 1/1987 | Lee | 381/86 |
| 4,756,382 | 7/1988 | Hudson, III | 181/156 |
| 4,903,300 | 2/1990 | Polk | 381/90 |
| 4,930,596 | 6/1990 | Saiki et al. | 381/99 |
| 5,274,709 | 12/1993 | Koizumi | 381/90 |

*Primary Examiner*—Huyen Le
*Attorney, Agent, or Firm*—Robert S. Smith

[57] ABSTRACT

A speaker system having increased sound quality comprising a first and second speakers each having a front and back. The first and second speakers cooperate with a duct having a first elongated portion in fluid communication with the rear of the first speaker and a second elongated portion in fluid communication with the rear of the second speaker. The duct has an elongated bass port defined therein intermediate the first and second portions. Each of the speakers have their fronts in contact with the air outside of the duct and the backs of the speakers are in contact with the air inside the duct. The duct may have a first spur intermediate the first and second speakers with a bass port in the first spur. The duct may have a second and third spur at the axial extremities with the first and second speakers respectively engaging the second and third spurs. Each spur may have an axis and the axes of the spurs may be generally coplanar for automobile use. The bass port may be offset between the second and third spurs. The second and third spurs may be connected to the first and second speakers with flared connections. In some forms of the invention the flared connections bolt to existing speaker hardware. The first spur may have an axial extremity with an oblique face. The duct may be constructed from plastic and may be fiberglass lined. For truck applications, each spur may have an axis and the axis of the first spur may be generally perpendicular to the axes of the second and third spurs.

17 Claims, 2 Drawing Sheets

AUDIO SPEAKER SYSTEM

BACKGROUND OF THE INVENTION

The invention relates to audio speaker systems and has particular application to audio speaker systems in motor vehicles although those skilled in the art will recognize that it will have application to other installations. Those skilled in the art will also recognize uses of the invention in commercial, consumer, industrial and residential applications.

A speaker system's sound quality is greatly enhanced when the speakers of the system are encased in an enclosure which contains a bass port. A bass port is a duct or vent added to a closed box in which the mass of air inside constitutes a resonance and the springlike compliance of the air in the enclosure constitutes a resonance circuit. If the resonance is properly tuned, the sound radiated through the duct opening from inside the enclosure effectively adds to the direct sound and can improve the response near the low cut-off frequency.

The prior art includes apparatus consisting of a plenum chamber having a plurality of speakers mounted on one wall that has a bass port in that wall. Such an enclosure takes up more room than the apparatus of the present invention.

It is an object of the invention to provide high quality sound with apparatus that is relatively inexpensive to manufacture.

It is an object of the invention to provide an apparatus which can be installed and retrofitted on all types of automobiles and trucks as well as residential and commercial applications.

Still another object of the invention is to provide an apparatus which is relatively inexpensive to install.

It is yet another object of the invention to provide an apparatus delivering high sound quality that is compact.

SUMMARY OF THE INVENTION

It has now been found that these and other objects of the invention may be attained in a speaker system having superior sound quality which includes a first and a second speaker each having a front and back connected by a duct having a first elongated portion in fluid communication with the rear of the first speaker and a second elongated portion in fluid communication with the rear of the second speaker. The duct also has an elongated bass port positioned intermediate the first and second speakers. Each of the speakers have the fronts thereof in contact with the air outside of the duct and the backs thereof in contact with the air inside the duct.

In some forms of the invention, the duct has a first spur intermediate the first and second speakers with the bass port in communication with the first speaker. The duct may have second and third spurs at the axial extremities with the first and second speakers respectively engaging the second and third spurs. The axes of the respective spurs may be coplanar. The bass port may be closer to the second spur than the third spur. The second and third spurs are respectively connected to the first and second speakers by means of flared connections secured to respective speakers in some forms of the invention. The first spur may have an axial extremity containing an oblique face. The preferred embodiment may have constructed the duct including the spurs from plastic although other materials may be used. The optimal size of the duct, spurs and bass port may be four inches wide and the duct including the spurs may be fiberglass lined.

In another form, generally for truck applications, each spur may have an axis and the axis of the first spur is generally perpendicular to the axes of the second and third spurs. The bass port may be closer to the second spur than the third spur. The second and third spurs are respectively connected to the first and second speakers by means of flared connections secured to respective speakers. The first spur may have an axial extremity that is perpendicular the axis thereof. The preferred embodiment may have the duct, including the spurs constructed from plastic although other materials may be used. The optimal size of the duct including spurs may be four inches wide. The duct including the spurs may be fiberglass lined.

BRIEF DESCRIPTION OF THE DRAWING

The invention will be better understood by reference to the accompanying drawing in which.

DESCRIPTION OF THE PREFERRED EMBODIMENT

Figure 1:
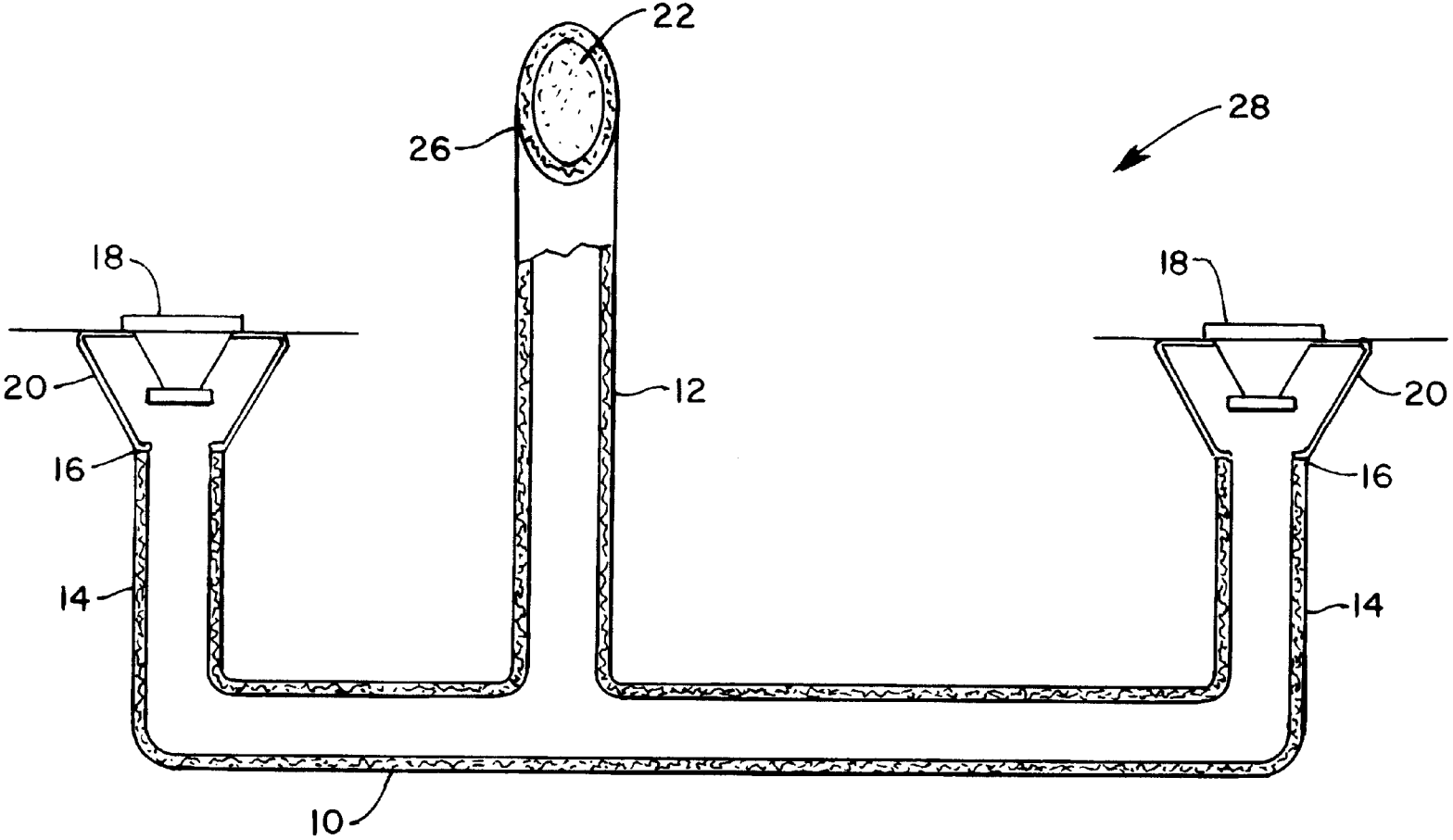
FIG. 1 is a partially cross-sectional view, through a vertical view, of the speaker system, particularly adapted to an automobile.
Figure 2:
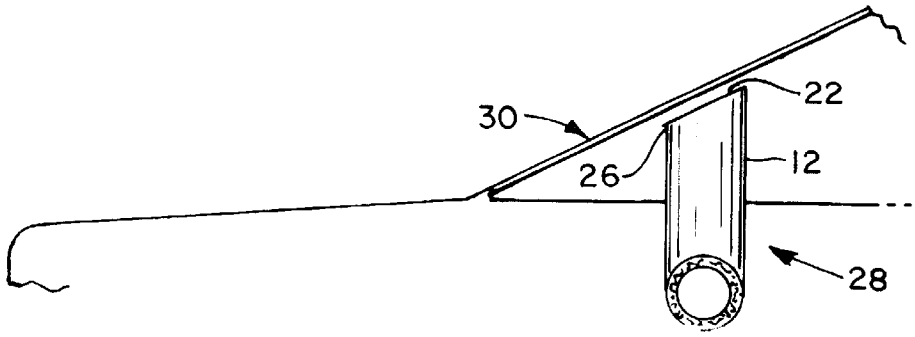
FIG. 2 is a partially schematic view depicting the bass port's oblique face.

Referring now to FIGS. 1 and 2 there is shown a preferred form of the speaker system 28 in accordance with the invention having particular application for installation in automobiles. It will be understood that the spur 12 which contains the bass port 22 will normally extend through the rear deck of the automobile although the spur 12 which contains the bass port 22 may be flush with the rear deck when the material covering the rear deck is of a mesh type. In other embodiments the spur 12 may extend above the deck.

The speaker system 28 encases the speakers 18. The speakers 18 will ordinarily be cone type speakers. Flared connections 20 join the speakers 18 to the axial extremities 16 of the spurs 14 of the duct 10. The flared connections 20 are ordinarily plastic although they may be fiberglass in other embodiments. The bass port 22 is defined in the axial extremity 26 of the spur 12 and, in one form of the invention, is connected to the duct 10 with the spur 12 located closer to one spur 14 than to the other spur 14. This offset puts the bass frequencies out of phase creating a "phase shift" at the bass port 22 in the axial extremity 26 in the spur 12 which will increase the effective bass. The axis of the spur 12, which contains the bass port 22, is coplanar to the axes of the two spurs 14 in the illustrated embodiment. For some applications the duct 10 including the spurs 12 and 14 are generally cylindrical. The axial extremity 26 of the spur 12 is will ordinarily be perpendicular the axis of the spur 12. However, in those embodiments in which the spur 12 extends above the deck the axial extremity may be oblique. The opening size of the bass port 22 tunes the bass frequency. The inside of the duct 10 is fiberglass lined in the preferred embodiment. The spurs 12 and 14 may also be fiberglass lined in some embodiments. The fiberglass lining reduces the echo effects within the duct 10 and the spurs 12 and 14. For some applications the diameter of the duct 10 and spurs 12 and 14 may be four inches. The duct 10 will be constructed of plastic in many embodiments.

As best seen in FIG. 2 it is sometimes desirable for the oblique face of the axial extremity 26 of the spur 12 housing the bass port 22 to be parallel to the automobile's rear window 30. This enables the sound leaving the bass port 22 to be reflected off the rear window 30 and fill the passenger compartment with sound.

Figure 3:
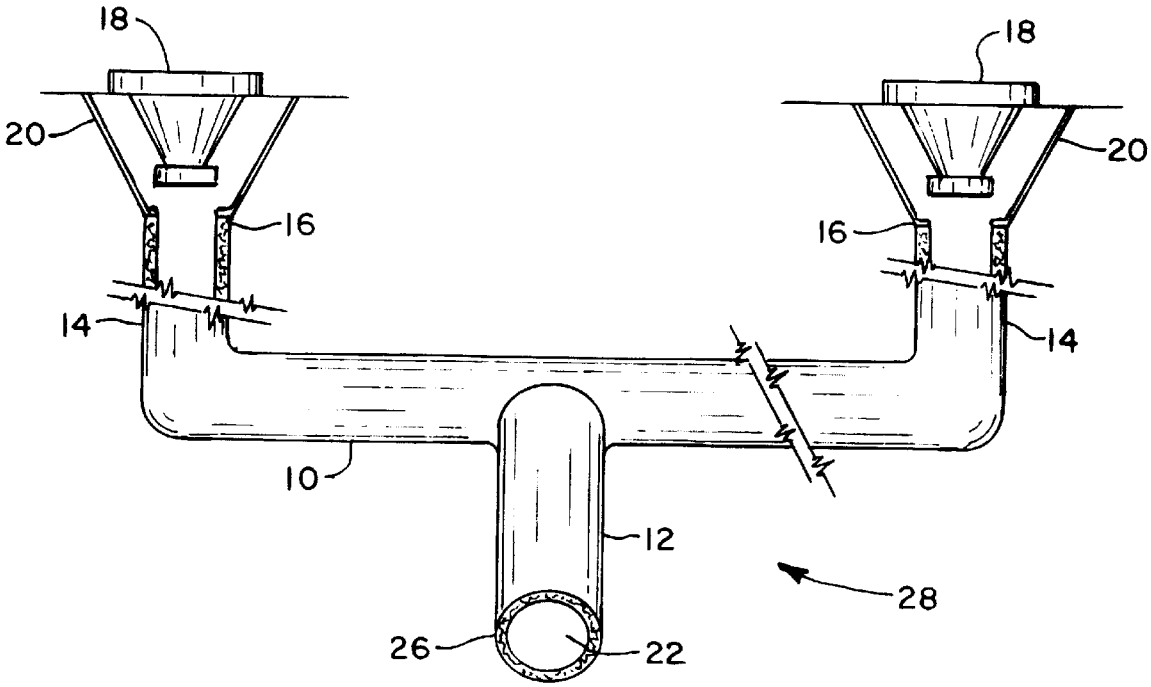
FIG. 3 is a partially schematic view of the speaker system in a truck embodiment.

FIG. 3 depicts the truck application of the speaker system 28. The speaker system 28 encases the speakers 18. Any cone type speaker may be used. Flared connections 20 join the speakers 18 to the axial extremities 16 of the spurs 14 of the duct 10. The flared connections 20 are generally constructed of plastic although they may be fiberglass in other embodiments. The bass port 22 is defined in the axial extremity 26 of the spur 12 and is connected to the duct 10 with the spur 12 located closer to one spur 14 than to the other spur 14. This offset puts the bass frequencies out of phase creating a "phase shift" at the bass port 22 in the axial extremity 26 in the spur 12 which will increase the effective bass. The spur 12 which contains the bass port 22 is perpendicular to the two spurs 14. For some applications the duct 10 including the spurs 12 and 14 are generally cylindrical. The face of the axial extremity 26 of the spur 12 is generally perpendicular to the axis of the spur 12. The opening size of the bass port 22 tunes the bass frequency. The inside of the duct 10 including the spurs 12 and 14 are fiberglass lined in the preferred embodiment. The fiberglass lining reduces the echo effects within the duct 10 and spurs 12 and 14. For some applications the diameter of the duct 10 and spurs 12 and 14 may be four inches. Usually the duct 10 is constructed of plastic.

The invention has been described with reference to its illustrated preferred embodiment. Persons skilled in the art of such devices may upon exposure to the teaching herein conceive other variations. For example, the invention may be used in surround sound systems. Such variations are deemed to be encompassed by the disclosure, the invention being delimited only by the following claims.

Having thus described my invention I claim:

1. A speaker system having increased sound quality which comprises:

a first and second speaker, said speakers each having a front and a back;

a duct having a first elongated portion, a second elongated portion and a third elongated portion, said first portion having an axial extremity in fluid communication with said back of said first speaker, said second portion having an axial extremity in fluid communication with said back of said second speaker; and said third portion being disposed intermediate said first and second portion;

said third portion includes an elongated first sour and a bass port is located at one end thereof, said sour being intermediate said first and second portions;

each of said speakers having the front thereof in contact with air outside of said duct and the back thereof in contact with air inside said duct, said first and second portions respectively include elongated second and third spurs at the axial extremities respectively of said first and second portions.

2. The apparatus as described in claim 1 wherein:

each of said spurs has an axis and said axes of said spurs are generally coplanar.

3. The apparatus as described in claim 2 wherein:

said bass port is closer to said second spur than said third spur.

4. The apparatus as described in claim 3 wherein:

said speakers are truncated conical elements and said second and third spurs have flared connections mating respectively with said first and second speakers.

5. The apparatus as described in claim 4 wherein:

said flared connections flare to a larger cross-section at the front of the speakers to which they are connected.

6. The apparatus as described in claim 1 wherein:

said first spur has an axial extremity having an oblique face.

7. The apparatus as described in claim 1 wherein:

said duct including said first, second and third spurs are constructed of plastic.

8. The apparatus as described in claim 7 wherein:

said duct is fiberglass lined.

9. The apparatus as described in claim 8 wherein:

said duct is generally cylindrical.

10. The apparatus as described in claim 1 wherein:

each of said spurs has an axis and said first spur has an axis that is generally perpendicular to said axes of said second and third spurs.

11. The apparatus as described in claim 10 wherein:

said bass port is closer to said second spur than said third spur.

12. The apparatus as described in claim 11 wherein:

said second and third spurs have flared connections that are respectively connected to said first and second speakers.

13. The apparatus as described in claim 12 wherein:

said flared connections are secured to respective speakers.

14. The apparatus as described in claim 10 wherein:

said first spur has an axial extremity having an oblique face.

15. The apparatus as described in claim 1 wherein:

said duct is constructed of plastic.

16. The apparatus as described in claim 15 wherein:

said duct is fiberglass lined.

17. The apparatus as described in claim 16 wherein:

said duct is generally cylindrical.

* * * * *